US011308844B2

(12) United States Patent
Xi et al.

(10) Patent No.: US 11,308,844 B2
(45) Date of Patent: Apr. 19, 2022

(54) MULTI-PRIMARY COLOR CONVERSION METHOD, DRIVING METHOD AND DRIVING DEVICE OF DISPLAY PANEL, AND DISPLAY DEVICE

(71) Applicant: BOE TECHNOLOGY GROUP CO., LTD., Beijing (CN)

(72) Inventors: Yanhui Xi, Beijing (CN); Bin Dai, Beijing (CN); Xiaomang Zhang, Beijing (CN); Haijun Niu, Beijing (CN); Kuanjun Peng, Beijing (CN); Xiaolong Li, Beijing (CN); Donghui Wang, Beijing (CN); Yan Sun, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 25 days.

(21) Appl. No.: 16/337,741

(22) PCT Filed: Nov. 13, 2018

(86) PCT No.: PCT/CN2018/115193
§ 371 (c)(1),
(2) Date: Mar. 28, 2019

(87) PCT Pub. No.: WO2019/114480
PCT Pub. Date: Jun. 20, 2019

(65) Prior Publication Data

US 2021/0335184 A1 Oct. 28, 2021

(30) Foreign Application Priority Data

Dec. 13, 2017 (CN) ..... 201711327189.5

(51) Int. Cl.
*G09G 3/20* (2006.01)
*G09G 5/02* (2006.01)

(52) U.S. Cl.
CPC ..... *G09G 3/2003* (2013.01); *G09G 5/02* (2013.01); *G09G 2300/0452* (2013.01); *G09G 2340/06* (2013.01)

(58) Field of Classification Search
CPC ..... G09G 3/2003; G09G 5/02
(Continued)

(56) References Cited

U.S. PATENT DOCUMENTS 6,774,953 B2 * 8/2004 Champion ..... H04N 9/641 348/453
7,598,961 B2 * 10/2009 Higgins ..... G09G 5/02 345/589

(Continued)

*Primary Examiner* — Prabodh M Dharia
(74) *Attorney, Agent, or Firm* — Nath, Goldberg & Meyer; Joshua B. Goldberg

(57) ABSTRACT

A multi-primary color conversion method is provided to include: establishing a spatial gamut model of a display panel; determining a target peripheral surface corresponding to the target color according to the color coordinates of the target color and color coordinates of a color corresponding to each vertex of each peripheral surface; obtaining reference gray scales of a part of primary colors of the target color according to gray scales of the primary colors of a color corresponding to each vertex of the target peripheral surface; obtaining reference gray scales of the rest primary colors of the target color and a reference luminance of the target color; and respectively converting the reference gray scales of the plurality of primary colors of the target color into target gray scales according to a proportional relationship between the reference luminance and the target luminance of the target color.

20 Claims, 3 Drawing Sheets

(58) Field of Classification Search
USPC ..... 345/690
See application file for complete search history.

(56) References Cited

U.S. PATENT DOCUMENTS

| | | | | |
|---|---|---|---|---|
| 7,926,950 | B2 * | 4/2011 | Mizushima | G03B 21/208 353/31 |
| 2004/0252130 | A1 * | 12/2004 | Lee | H04N 9/67 345/603 |
| 2006/0158881 | A1 * | 7/2006 | Dowling | G03G 15/0435 362/231 |
| 2009/0262129 | A1 * | 10/2009 | Selbrede | G02B 26/02 345/590 |
| 2014/0267456 | A1 * | 9/2014 | Ando | G09G 3/3413 345/690 |
| 2020/0226965 | A1 * | 7/2020 | Xi | G09G 3/3607 |

* cited by examiner

MULTI-PRIMARY COLOR CONVERSION METHOD, DRIVING METHOD AND DRIVING DEVICE OF DISPLAY PANEL, AND DISPLAY DEVICE

CROSS-REFERENCE TO RELATED APPLICATION

This is a National Phase Application filed under 35 U.S.C. 371 as a national stage of PCT/CN2018/115193, filed Nov. 13, 2018, an application claiming the benefit of Chinese Patent Application No. 201711327189.5, filed on Dec. 13, 2017, the contents of each of which are incorporated herein by reference in their entirety.

TECHNICAL FIELD

The present disclosure relates to the field of display technology, more particularly, to a multi-primary color conversion method, a method and a device for driving a display panel, and a display device.

BACKGROUND

During display of a three primary color (red, green, blue) display panel, when the color coordinates (x, y) and the luminance information Y of a target color are known, stimulus values of the three primary colors can be easily obtained according to the conversion relationship between CIE1931 RGB, CIE1931 XYZ, and CIE1931 xyY, and thus corresponding signals are provided for red, green and blue pixels according to the stimulus values of the three primary colors to display the desired target color.

SUMMARY

The present disclosure provides a multi-primary color conversion method, a method and a device for driving a display panel, and a display device which facilitate accurate conversion of color information of a target color into gray scales of multiple primary colors.

The present disclosure provides a multi-primary color conversion method for converting color information of a target color to be displayed into target gray scales of a plurality of primary colors, a number of the plurality of primary colors being greater than 3, the color information of the target color including color coordinates ($x_0$, $y_0$) and a target luminance ($Y_0$) of the target color, and the multi-primary color conversion method includes:

establishing a spatial gamut model of a display panel in a CIE xyY color space according to all colors that can be displayed by the display panel, the spatial gamut model being formed by a plurality of peripheral surfaces and an xoy plane of the CIE xyY color space; wherein each of the plurality of peripheral surfaces has a plurality of vertices such that a projection of the peripheral surface on the xoy plane is in the shape of a polygon, each vertex of the polygon is a point at which a color obtained when at least one primary color has a maximum value is located, and inner regions of the projections of different peripheral surfaces on the xoy plane do not overlap;

determining a target peripheral surface corresponding to the target color according to the color coordinates of the target color and color coordinates of a color corresponding to each vertex of each of the plurality of peripheral surfaces;

obtaining reference gray scales of a part of the plurality of primary colors of the target color according to gray scales of the plurality of primary colors of a color corresponding to each vertex of the target peripheral surface;

obtaining reference gray scales of the rest of the plurality of primary colors of the target color and a reference luminance of the target color according to the obtained reference gray scales of the part of the plurality of primary colors of the target color and relationship between gray scales of the plurality of primary colors of the target color and the reference luminance and the color coordinates of the target color; and converting the reference gray scale of each of the plurality of primary colors of the target color into a target gray scale according to a proportional relationship between the reference luminance and the target luminance of the target color.

In an embodiment, the number of the plurality of primary colors is six; and the step of obtaining reference gray scales of a part of the plurality of primary colors of the target color according to gray scales of the plurality of primary colors of a color corresponding to each vertex of the target peripheral surface includes obtaining reference gray scales of four primary colors of the target color.

In one embodiment, the step of obtaining reference gray scales of the rest of the plurality of primary colors of the target color and a reference luminance of the target color includes:

determining the reference gray scales of the other two primary colors of the target color and the reference luminance Ymax of the target color according to the obtained reference gray scales of the four primary colors of the target color, the color coordinates ($x_0$, $y_0$) of the target color, and the following formula:

$$\begin{pmatrix} X_{max} \\ Y_{max} \\ Z_{max} \end{pmatrix} = \begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix} \begin{pmatrix} \text{Gray_}R \\ \text{Gray_}G \\ \text{Gray_}B \\ \text{Gray_}YE \\ \text{Gray_}C \\ \text{Gray_}M \end{pmatrix}$$

where four of Gray_R, Gray_G, Gray_B, Gray_YE, Gray_C, and Gray_M are: the reference gray scales of the four primary colors obtained according to gray scales of the plurality of primary colors of the color corresponding to each vertex of the target peripheral surface; and the other two are the reference gray scales of the other two primary colors to be determined;

Xmax, Ymax, and Zmax constitute tristimulus values corresponding to a color having color coordinates of ($x_0$, $y_0$) and a luminance of Ymax in the CIE XYZ system; and $$X_{max} = \frac{x_0}{y_0} Y_{max}, \text{ and } Z_{max} = \frac{1 - x_0 - y_0}{y_0} Y_{max};$$

$$\text{and} \begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix}$$

is a conversion matrix between gray scales of six primary colors and the tristimulus values in the CIE XYZ system for the display panel, and each element in the matrix is a preset constant.

In one embodiment, the step of establishing a spatial gamut model of a display panel in a CIE xyY color space according to all colors that can be displayed by the display panel includes:

setting a plurality of sets of sample gray scales of the six primary colors, a sample gray scale of each primary color being within a preset gray scale range;

for each set of sample gray scales of the six primary colors, determining color coordinates (x', y') and luminance Y' of a sample color displayed by the display panel according to formula (1) and formula (2):

$$x' = \frac{X'}{X' + Y' + Z'} \quad y' = \frac{Y'}{X' + Y' + Z'} \quad z' = \frac{Z'}{X' + Y' + Z'} \tag{1}$$

$$\begin{pmatrix} X' \\ Y' \\ Z' \end{pmatrix} = \begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix} \begin{pmatrix} \text{Gray_}R' \\ \text{Gray_}G' \\ \text{Gray_}B' \\ \text{Gray_}YE' \\ \text{Gray_}C' \\ \text{Gray_}M' \end{pmatrix} \tag{2}$$

where Gray_R', Gray_G', Gray_B', Gray_YE', Gray_C' and Gray_M' are the sample gray scales of the six primary colors, respectively; X', Y' and Z' constitute tristimulus values corresponding to the sample color in the CIE XYZ system; and $$\begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix}$$

is a conversion matrix between gray scales of the six primary colors and the tristimulus values in the CIE XYZ system for the display panel, and each element in the matrix is a preset constant; and.

establishing the spatial gamut model of the display panel in the CIE xyY color space according to the color coordinates and the luminances of all of the sample colors.

In one embodiment, the step of obtaining reference gray scales of a part of the plurality of primary colors of the target color according to gray scales of the plurality of primary colors of a color corresponding to each vertex of the target peripheral surface includes:

obtaining the gray scales of the six primary colors of the color corresponding to each vertex of the target peripheral surface, wherein a gray scale of each of L1 primary colors of the color corresponding to each vertex of the target peripheral surface is a maximum value in the preset gray scale range, and a gray scale of each of L2 primary colors of the color corresponding to each vertex of the target peripheral surface is a minimum value in the preset gray scale range, where L1 and L2 are both integers greater than or equal to 0, and L1+L2=4; and for each of the six primary colors, determining the reference gray scale of the primary color in the target color to be the maximum value in the preset gray scale range when the gray scale of the primary color in the color corresponding to each vertex is the maximum value in the preset gray scale range; and determining the reference gray scale of the primary color in the target color to be the minimum value in the preset gray scale range when the gray scale of the primary color in the color corresponding to each vertex is the minimum value in the preset gray scale range.

In one embodiment, the preset gray scale range is 0 to 1; or the preset gray scale range is 0 to $2^n-1$, where n is an integer greater than 1.

In one embodiment, the peripheral surface has four vertices such that the projection of the peripheral surface on the xoy plane of the CIE xyY color space is in the shape of a quadrangle; and the step of determining a target peripheral surface corresponding to the target color according to the color coordinates of the target color and color coordinates of a color corresponding to each vertex of each of the plurality of peripheral surfaces includes:

obtaining the color coordinates ($x_0$, $y_0$) of the target color;

for each of the plurality of peripheral surfaces, obtaining the color coordinates ($x_1$, $y_1$), ($x_2$, $y_2$), ($x_3$, $y_3$) and ($x_4$, $y_4$) of the colors corresponding to the vertices of the peripheral surface, and calculating values of a, b, c and d according to the following formula:

$$\begin{cases} a = (x_2 - x_1)(y_0 - y_1) - (y_2 - y_1)(x_0 - x_1) \\ b = (x_3 - x_2)(y_0 - y_2) - (y_3 - y_2)(x_0 - x_2) \\ c = (x_4 - x_3)(y_0 - y_3) - (y_4 - y_3)(x_0 - x_3) \\ d = (x_1 - x_4)(y_0 - y_4) - (y_1 - y_4)(x_0 - x_4) \end{cases}$$

and determining the peripheral surface to be the target peripheral surface corresponding to the target color when a, b, c and d are of a same sign.

In one embodiment, the step of converting the reference gray scale of each of the plurality of primary colors of the target color into a target gray scale according to a proportional relationship between the reference luminance and the target luminance of the target color includes:

dividing the target luminance of the target color by the reference luminance of the target color to obtain a coefficient of proportionality of the target luminance to the reference luminance; and for each of the plurality of primary colors of the target color, obtaining a product of the reference gray scale of the primary color and the coefficient of proportionality, and using the obtained product as the target gray scale of the primary color.

In one embodiment, the plurality of primary colors include red, green, blue, yellow, cyan, and magenta.

Correspondingly, the present disclosure further provides a driving method for driving a display panel to display an image to be displayed, wherein the display panel includes a plurality of display pixel units each including display sub-pixel units having a plurality of primary colors, and a number of the plurality of primary colors is greater than 3, and the driving method includes:

obtaining color information of a target color of each image pixel unit in the image to be displayed;

converting the color information of the target color of each display pixel unit into gray scales of the plurality of primary colors using the multi-primary color conversion method provided by the present disclosure, the color information of the target color including color coordinates and a target luminance of the target color; and providing a corresponding driving signal to each display pixel unit of the display panel according to the gray scales of the plurality of primary colors such that each display pixel unit of the display panel displays the target color.

Correspondingly, the present disclosure also provides a driving device for driving a display panel, the display panel including a plurality of display pixel units, each of the plurality of display pixel units including display sub-pixel units having a plurality of primary colors, and a number of the plurality of primary colors being greater than 3, wherein the device includes at least one processor, and a memory for storing at least one program; the at least one program causes the at least one processor to perform the above driving method according to the present disclosure when executed by the at least one processor.

Correspondingly, the present disclosure also provides a display device including a display panel and the driving device for driving the display panel, wherein the display panel includes a plurality of display pixel units each including display sub-pixel units having a plurality of primary colors, and a number of the plurality of pixel units is greater than 3.

In one embodiment, the plurality of display sub-pixel units include a red display sub-pixel unit, a green display sub-pixel unit, a blue display sub-pixel unit, a cyan display sub-pixel unit, a yellow display sub-pixel unit, and a magenta display sub-pixel unit.

BRIEF DESCRIPTION OF THE DRAWINGS

Accompanying drawings, which are intended to provide a further understanding of the disclosure and constitute a part of the specification, are used for explaining the present disclosure together with the following specific implementations, rather than limiting the present disclosure. In the accompanying drawings.

DETAILED DESCRIPTION

Figure 1:
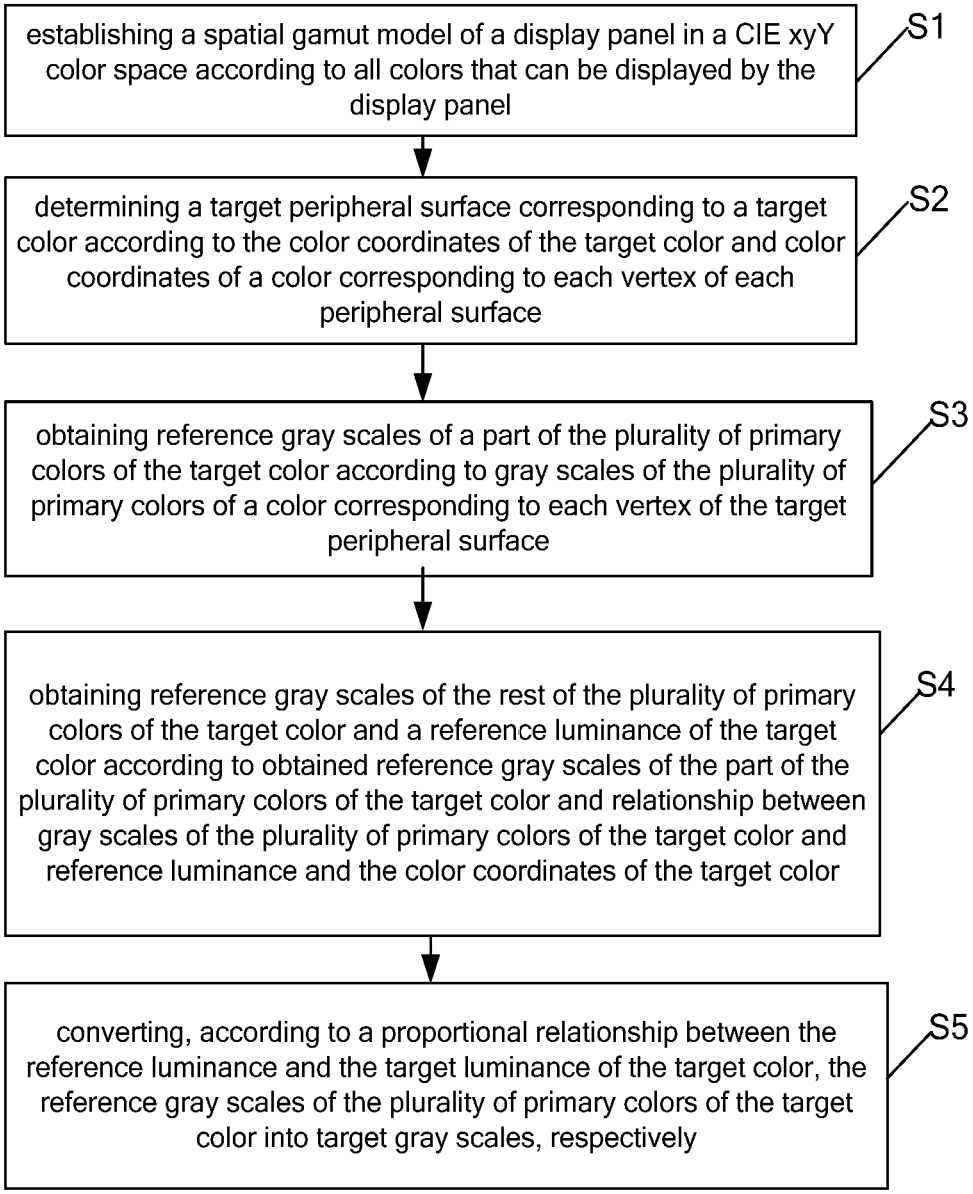
FIG. 1 is a flow chart of a multi-primary color conversion method provided in an embodiment of the present disclosure.

The specific implementations of the present disclosure will be described in detail below with reference to the accompanying drawings. It is to be understood that the specific implementations described herein are not to be construed to limit the present disclosure.

With the continuous development of display technology, the requirements on the resolution and performance of the display screen are getting higher and higher, resulting in increased power consumption of the screen and increased amount of data transmission. A conventional three-primary color display panel has limited display capability, and can only display colors in a certain range. In order to solve the problem of increased power consumption and amount of data transmission caused by increased resolution of the screen, and meet the high requirement on the performance of the screen, some manufacturers have proposed a six-primary color display panel. However, when driving the six-primary color display panel to display, color information (i.e., color coordinates and luminance) of a target color cannot be accurately converted into gray scales of the six primary colors, so that the six-primary color display panel can hardly display the target color accurately.

Currently, for a three-primary color (red, green, blue) display panel, the color information (including the color coordinates $x_0$, $y_0$ and target luminance $Y_0$) of a target color is converted into gray scales Gray_$R_0$, Gray_$G_0$, and Gray_$B_0$ of the three primary colors through a conversion relationship between the gray scales of the three primary colors and the color information (referring to the following formula (0-1) and formula (0-2)):

$$\begin{pmatrix} X_0 \\ Y_0 \\ Z_0 \end{pmatrix} = \begin{pmatrix} X_R & X_G & X_B \\ Y_R & Y_G & Y_B \\ Z_R & Z_G & Z_B \end{pmatrix} \begin{pmatrix} \text{Gray_R}_0 \\ \text{Gray_G}_0 \\ \text{Gray_B}_0 \end{pmatrix} \tag{0-1}$$

$$\begin{aligned} x_0 &= X_0/(X_0+Y_0+Z_0) \\ y_0 &= Y_0/(X_0+Y_0+Z_0) \\ z_0 &= Z_0/(X_0+Y_0+Z_0) \end{aligned} \tag{0-2}$$

where $X_0$, $Y_0$ and $Z_0$ are the tristimulus values corresponding to the target color in the CIE XYZ system (i.e., CIE1931 XYZ system), and $Y_0$ is also the target luminance of the target color;

$$\begin{pmatrix} X_R & X_G & X_B \\ Y_R & Y_G & Y_B \\ Z_R & Z_G & Z_B \end{pmatrix}$$

is a conversion matrix between the gray scales of the three primary colors and the tristimulus values in the CIE XYZ system for the display panel, where $X_R$, $X_G$ and $X_B$ are respectively three conversion coefficients of the three primary colors for converting the gray scales Gray_$R_0$, Gray_$G_0$, and Gray_$B_0$ of the three primary colors into the stimulus value $X_0$; $Y_R$, $Y_G$ and $Y_R$ are respectively three conversion coefficients of the three primary colors for converting the gray scales Gray_$R_0$, Gray_$G_0$, and Gray_$B_0$ of the three primary colors into the stimulus value $Y_0$; $Z_R$, $Z_G$ and $Z_B$ are respectively three conversion coefficients of the three primary colors for converting the gray scales Gray_$R_0$, Gray_$G_0$, and Gray_$B_0$ of the three primary colors into the stimulus value $Z_0$. It should be understood that each element in the matrix is a predetermined constant.

Specifically, when performing the three primary color conversion using the above formulas (0-1) and (0-2), the values of $X_0$ and $Z_0$ are first obtained according to the formula (0-2), and the values of $X_0$, $Y_0$, and $Z_0$ are substituted into the formula (0-1), so that three equations for the three gray scales to be calculated can be obtained, thereby obtaining unique values of the gray scales of the three primary colors. However, in a case where the number of the primary colors of the display panel is greater than 3, three equations for the gray scales of the multiple primary colors are obtained, and the number of unknowns is greater than 3, so that it is impossible to accurately obtain the gray scale of each primary color, that is, the color information of the target color cannot be accurately converted into the gray scales of the multiple primary colors.

In order to solve the technical problem in the related art that the color information of the target color cannot be accurately converted into the gray scales of multiple primary colors, the present disclosure provides a multi-primary color conversion method for converting color information of a target color to be displayed into target gray scales of the multiple primary colors, the number of the multiple primary colors being greater than 3, and the color information of the target color including color coordinates and a target luminance of the target color. As shown in FIG. 1, the multi-primary color conversion method includes the following steps S1 to S5.

Figure 3A:
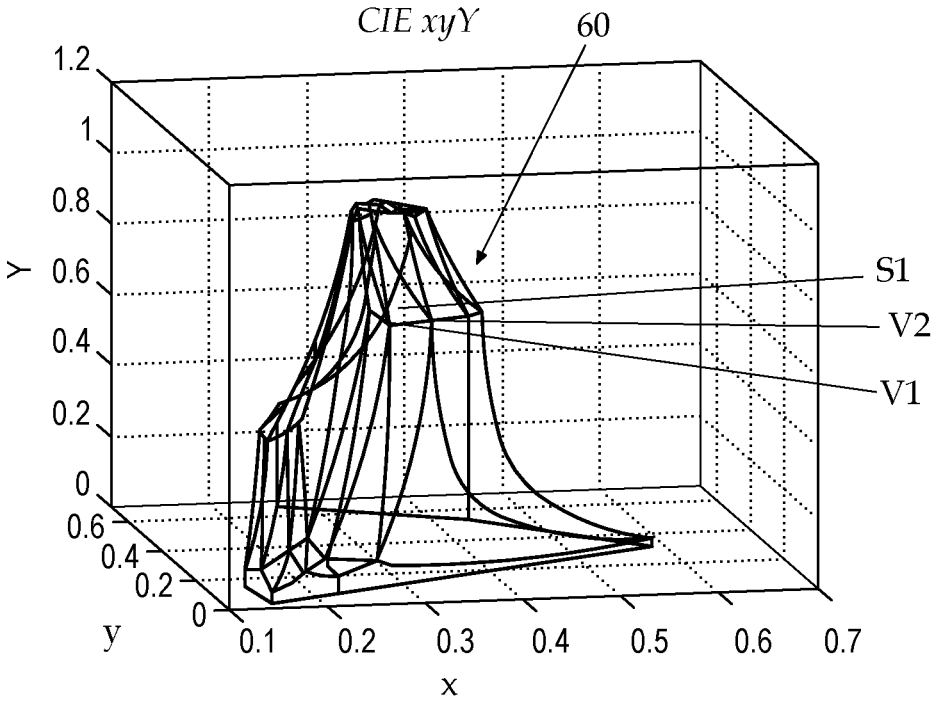
FIG. 3*a* is a spatial gamut model of a display panel.
Figure 3B:
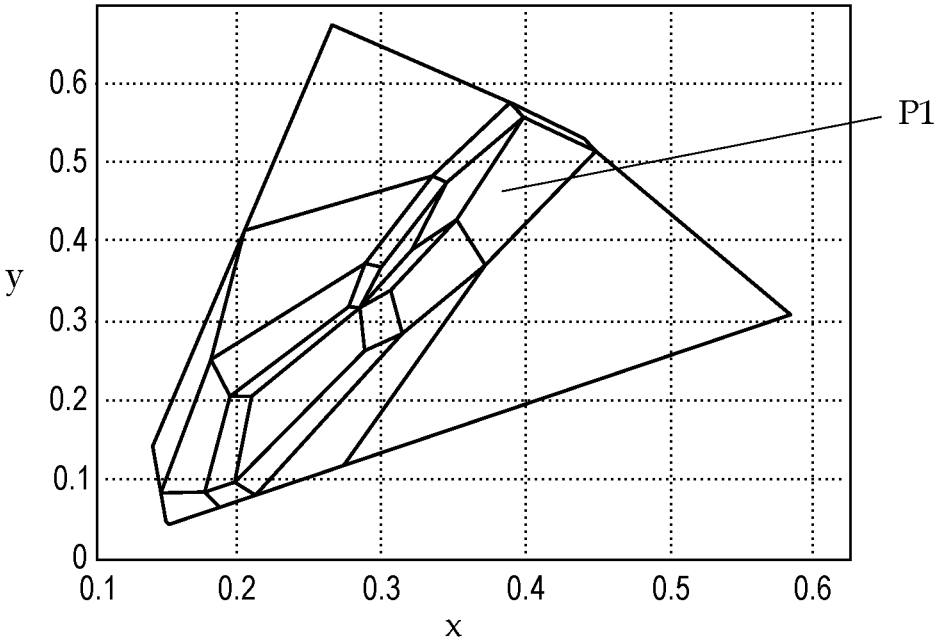
FIG. 3*b* is a diagram illustrating distribution of projections of peripheral surfaces of a spatial gamut model on an xoy plane.

Step S1 includes: establishing a spatial gamut model 60 of the display panel in a CIE xyY color space (i.e., CIE1931 xyY color space) according to all colors that can be displayed by the display panel. As shown in FIG. 3*a*, the spatial gamut model 60 is formed by a plurality of peripheral surfaces and an xoy plane of the CIE xyY color space. Each peripheral surface S1 has a plurality of vertices, for example V1 and V2, a projection of each peripheral surface on the xoy plane is, as shown in FIG. 3*b*, in the shape of a polygon P1, and inner regions of the projections of different peripheral surfaces on the xoy plane do not overlap. It should be understood that the expression "inner regions of the projections of different peripheral surfaces on the xoy plane do not overlap" herein means that a part of boundaries of two peripheral surfaces may coincide, but the regions within the boundaries do not overlap. It can be understood that in the CIE xyY color space, the color is specified by the luminance and color coordinates (x, y). For example, in the CIE xyY color space, the point whose position coordinates are (a, b, c) represents a color whose color coordinates are (a, b) and whose luminance is c. In other words, according to the color coordinates and luminance of a color, a point corresponding to the color can be found in the CIE xyY space.

Step S2 includes: determining a target peripheral surface corresponding to the target color according to the color coordinates of the target color and color coordinates of a color corresponding to each vertex of each of the plurality of peripheral surfaces. The target peripheral surface corresponding to the target color refers to a peripheral surface into which the point corresponding to the target color falls in a direction perpendicular to the xoy plane. That is, an orthographic projection of the point corresponding to the target color on the xoy plane is located within an orthographic projection of the target peripheral surface on the xoy plane.

Step S3 includes: obtaining reference gray scales of a part of the plurality of primary colors of the target color according to the gray scale of each primary color of the color corresponding to each vertex of the target peripheral surface. It should be noted that the "gray scale" in the present disclosure may be a gray scale value that is not normalized (e.g., the gray scale ranges from 0 to 255), or may be a normalized gray scale value (i.e., the gray scale ranges from 0 and 1).

It can be understood that the color coordinates of the target color are the same as color coordinates of the color corresponding to a projection, on the target peripheral surface, of the point corresponding to the target color, and gray scales of a part of the plurality of primary colors of the color corresponding to each point on the target peripheral surface are the same as the gray scales of a part of the primary colors of the color corresponding to each vertex of the target peripheral surface. Therefore, the reference gray scales of a part of the plurality of primary colors of the target color can be obtained according to the gray scale of each primary color of the color corresponding to each vertex of the target peripheral surface. For example, in a case where the gray scale of red in the color corresponding to each vertex of the target peripheral surface is 0, then the gray scale of red in the color corresponding to each point of the target peripheral surface is 0, and therefore, the reference gray scale of red in the target color is determined to be 0.

Step S4 includes: obtaining reference gray scales of the rest of the plurality of primary colors of the target color and a reference luminance of the target color according to the obtained reference gray scales of the part of the plurality of primary colors of the target color and the relationship between the gray scale of each primary color of the target color and the reference luminance and color coordinates of the target color.

Step S5 includes: converting the reference gray scale of each primary color of the target color into a target gray scale according to a proportional relationship between the reference luminance and the target luminance of the target color.

During conversion of the color information of the target color into gray scales of a plurality of primary colors using the method provided by the present disclosure, the gray scale(s) of a part of the primary colors is first determined by using the spatial gamut model 60, and therefore, in the three equations obtained according to the conversion relationship between the gray scales of the plurality of primary colors and the color information, the number of unknowns is less than the number of the plurality of primary colors, which facilitates the conversion of the color information of the target color to be displayed into the target gray scales of the plurality of primary colors.

The multi-primary color conversion method of the present disclosure is particularly suitable for converting color information of a target color into gray scales of six primary colors, which are red (R), green (G), blue (B), yellow (Y), Cyan (C) and Magenta (M), respectively. The multi-primary color conversion method of the present disclosure will be described in detail below by taking the six primary colors as an example.

The multi-primary color conversion method includes the following steps S1 to S5.

Figure 2:
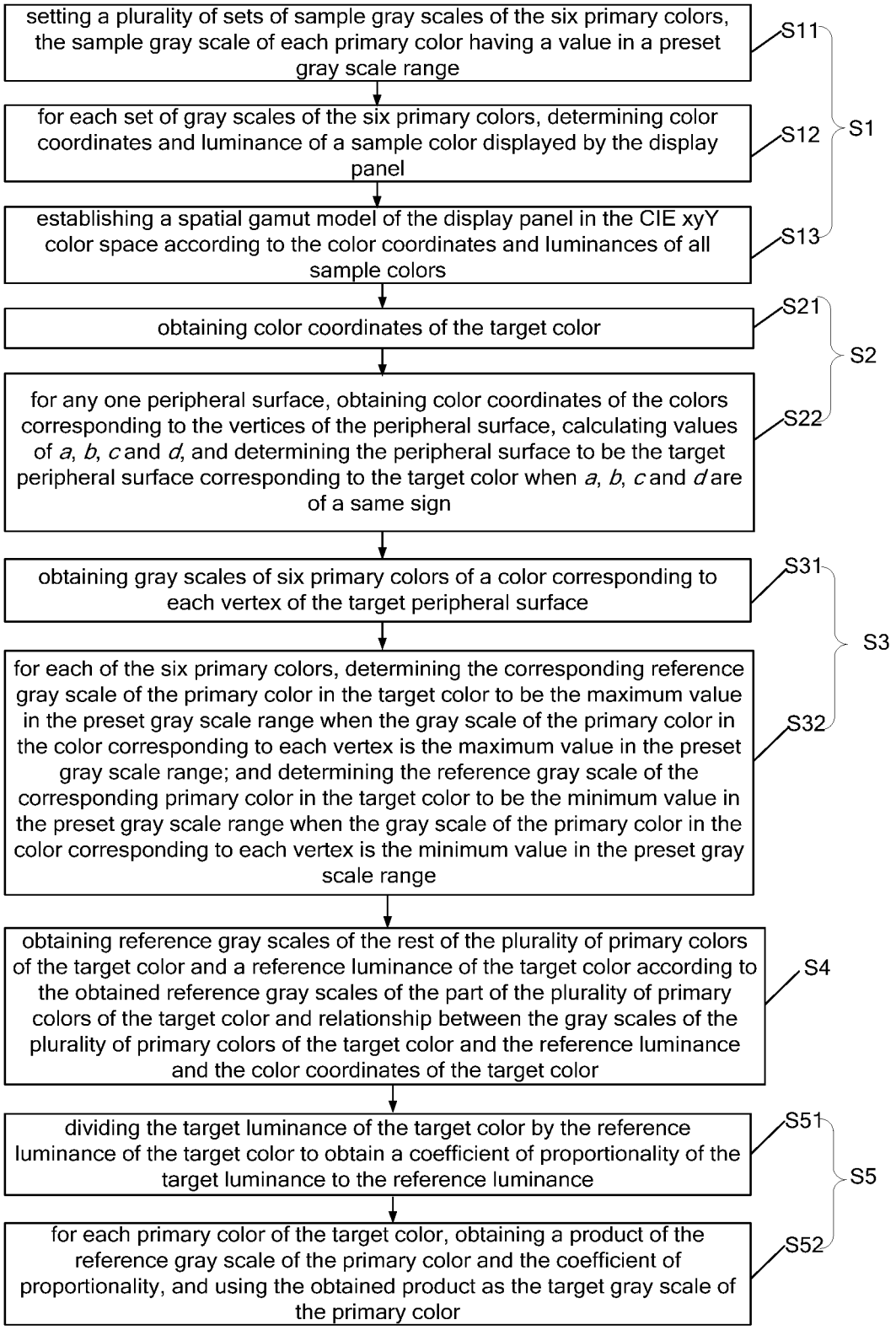
FIG. 2 is a flow chart of a multi-primary color conversion method provided in an embodiment of the present disclosure.

Step S1 includes: establishing a spatial gamut model 60 of the display panel in the CIE xyY color space according to all colors that can be displayed by the display panel. In practical applications, Matlab software may be used to draw all colors. The spatial gamut model is formed by a plurality of peripheral surfaces and an xoy plane of the CIE xyY color space. Each peripheral surface has four vertices such that a projection of the peripheral surface on the xoy plane is in the shape of a quadrangle, the vertices of each quadrangle are points each representing a pure color, and therefore, points within the quadrangle may be obtained by merging the four vertices. Each vertex of the quadrangle indicates which one(s) of the plurality of primary colors has(have) the maximum value and which the other one(s) of the plurality of primary colors has(have) the minimum value, and a color obtained by mixing the primary color(s) having the maximum value and the remaining primary color(s) is located at the point. For example, for a quadrangle whose vertices are G-GY-GC-GYC, the vertex G represents a point at which a color obtained by mixing green (G) whose value is 255 (i.e., G=255) and the other five primary colors whose stimuli values are 0; at the vertex GY, G=Y=255, and R=B=M=M=C=0 at the vertex GC: G=C=255, and R=B=M=Y=0; at the vertex GYC: G=Y=C=255, and R=B=M=0. Colors corresponding to the points within the quadrangle have the common features: G=255, R=B=M=0. In a case where the target color is within the quadrangle, four of the six stimuli values are known. projections of different peripheral surfaces on the xoy plane do not overlap. Specifically, as shown in FIG. 2, the step S1 includes the following steps S1 to S13.

Step S1 includes: setting a plurality of sets of sample gray scales of the six primary colors such that the sample gray scale of each primary color has a value in a preset gray scale range. As described above, the "gray scale" of the present disclosure may be a gray scale that is not normalized. Accordingly, the preset gray scale range is 0 to $2^n-1$, where n is an integer greater than 1. Specifically, n may be 8, and the preset gray scale range is 0 to 255. The "gray scale" of the present disclosure may also be a normalized gray scale, and correspondingly, the preset pay scale range is 0 to 1.

Step S12 includes: for each set of gray scales of the six primary colors, determining color coordinates (x', y') and luminance r of a sample color displayed by the display panel according to formula (1) and formula (2):

$$x' = \frac{X'}{X'+Y'+Z'} \quad y' = \frac{Y'}{X'+Y'+Z'} \quad z' = \frac{Z'}{X'+Y'+Z'} \tag{1}$$

$$\begin{pmatrix} X' \\ Y' \\ Z' \end{pmatrix} = \begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix} \begin{pmatrix} \text{Gray_R}' \\ \text{Gray_G}' \\ \text{Gray_B}' \\ \text{Gray_YE}' \\ \text{Gray_C}' \\ \text{Gray_M}' \end{pmatrix} \tag{2}$$

where Gray_R', Gray_G', Gray_B', Gray_YE', Gray_C' and Gray_M' are the sample gray scales of the six primary colors; X', Y' and Z' constitute tristimulus values corresponding to the sample color in the CIE XYZ system; and $$\begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix}$$

is a conversion matrix between gray scales of the six primary colors and the tristimulus values in the CIE XYZ system for the display panel, and each element in the matrix is a preset constant. Specifically, in a case where the gray scales of the six primary colors are Gray_R', Gray_G', Gray_B', Gray_YE', Gray_C', and Gray_M', respectively, and the tristimulus values are X', Y' and Z', respectively, $X_R$, $X_G$, $X_B$, $X_{YE}X_C$, and $X_M$ are conversion coefficients for converting the six primary colors into the stimulus value X'; $Y_R$, $Y_G$, $Y_B$, $Y_{YE}$, $Y_C$, and $Y_M$ are conversion coefficients for converting the six primary colors into the stimulus value Y'; and $Z_R$, $Z_G$, $Z_{YE}$, $Z_C$, and $Z_M$ are conversion coefficients for converting the six primary colors into the stimulus value Z'.

Step S13 includes: establishing a spatial gamut model of the display panel in the CIE xyY color space according to the color coordinates and luminances of all sample colors. The spatial gamut model has 24 peripheral surfaces each having four vertices.

Step S2 includes: determining a target peripheral surface corresponding to the target color according to the color coordinates of the target color and color coordinates of the color corresponding to each vertex of each peripheral surface. Specifically, a projection of the point corresponding to the target color on the xoy plane is point P, and projections of the vertices of a peripheral surface on the xoy plane are $O_1$, $O_2$, $O_3$, and $O_4$, respectively. If the peripheral surface determined by $O_1$, $O_2$, $O_3$, and $O_4$ is the target peripheral surface, the following four vector products $\overline{O_1O_2}\times\overline{O_1P}$, $\overline{O_2O_3}\times\overline{O_2P}$, $\overline{O_3O_4}\times\overline{O_3P}$ and $\overline{O_4O_1}\times\overline{O_4P}$ are of a same sign. Accordingly, as shown in FIG. 2, the step S2 includes:

step S21: obtaining color coordinates ($x_0$, $y_0$) of the target color; and step S22: for any one of the plurality of peripheral surfaces, obtaining color coordinates ($x_1$, $y_1$), ($x_2$, $y_2$) ($x_3$, $y_3$) and ($x_4$, $y_4$) of the colors corresponding to the vertices of the peripheral surface, and calculating values of a, b, c and d according to the following formula (3):

$$a=(x_2-x_1)(y_0-y_1)-(y_2-y_1)(x_0-x_0-x_1)$$

$$b=(x_3-x_2)(y_0-y_2)-(y_3-y_2)(x_0-x_2)$$

$$c=(x_4-x_3)(y_0-y_3)-(y_4-y_3)(x_0-x_3)$$

$$d=(x_1-x_4)(y_0-y_4)-(y_1-y_4)(x_0-y_4) \tag{3};$$

determining the peripheral surface to be the target peripheral surface corresponding to the target color if a, b, c and d are of a same sign. It should be understood that whether a, b, c and d are of a same sign means whether a, b, c and d are all positive or negative. It should be noted that when any one of a, b, c and d is 0, it can be regarded as positive or negative. For example, in a case where a, h, c and d are all greater than or equal to 0, or all less than or equal to 0, a, b, c and d are considered to be of a same sign.

Step S3 includes: obtaining reference gray scales of a part of the plurality of primary colors of the target color according to the gray scale of each primary color of a color corresponding to each vertex of the target peripheral surface. Specifically, the step S3 includes steps S31 and S32.

Step S31 includes: obtaining gray scales of six primary colors of a color corresponding to each vertex of the target peripheral surface. The gray scale(s) of L primary color(s) of the color corresponding to each vertex of the target peripheral surface is the maximum value in the preset gray scale range, and the gray scale(s) of L2 primary color(s) of the color corresponding to each vertex of the target peripheral surface is the minimum value in the preset gray scale range, where L1 and L2 are integers greater than or equal to 0, and L1+L2=4.

Step S32 includes: for each of the six primary colors, determining the reference gray scale of the primary color in the target color to be the maximum value in the preset gray scale range when the gray scale of the primary color in the color corresponding to each vertex is the maximum value in the preset gray scale range; and determining the reference gray scale of the primary color in the target color to be the minimum value in the preset gray scale range when the gray scale of the primary color in the color corresponding to each vertex is the minimum value in the preset gray scale range. For example, the preset gray scale range is 0 to 255, if the gray scale of red in the color corresponding to each vertex is 255, the reference gray scale of red in the target color is also 255; if the gray scale of green in the color corresponding to each vertex is 0, the reference gray scale of green in the target color is also 0. For the four vertices of any peripheral surface, the sum of the number of primary color(s) whose gray scale(s) is(are) always 255 and the number of primary color(s) whose gray scale(s) is(are) always 0 is 4, and thus the reference gray scales of four primary colors in the target color can be determined according to step S32.

Step S4 includes: obtaining reference gray scales of the remaining primary color(s) of the target color and a reference luminance of the target color according to the obtained reference gray scales of the four primary colors of the target color and the relationship between the gray scale of each primary color of the target color and the reference luminance and color coordinates of the target color. Specifically, the step S4 includes:

determining the reference gray scales of the other two primary colors of the target color and the reference luminance Ymax of the target color according to the obtained reference gray scales of the four primary colors of the target color obtained in step S3, the color coordinates ($x_0$, $y_0$)) of the target color, and formula (4):

$$\begin{pmatrix} X_{max} \\ Y_{max} \\ Z_{max} \end{pmatrix} = \begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix} \begin{pmatrix} \text{Gray_R} \\ \text{Gray_G} \\ \text{Gray_B} \\ \text{Gray_YE} \\ \text{Gray_C} \\ \text{Gray_M} \end{pmatrix} \quad (4)$$

where four of Gray_R, Gray_G, Gray_B, Gray_YE, Gray_C and Gray_M are the reference gray scales of the four primary colors obtained in step S3 and the other two are the reference gray scales of the other two primary colors to be determined. Xmax, Ymax and Zmax constitute tristimulus values corresponding to a color having color coordinates of ($x_2$, $y_0$) and a luminance of Ymax in the CIE XYZ system, $$X_{max} = \frac{x_0}{y_0} Y_{max} \text{ and } Z_{max} = \frac{1 - x_0 - y_0}{y_0} Y_{max}; \text{ and}$$

$$\begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix}$$

is a conversion matrix between the gray scales of six primary colors and the tristimulus values in the CIE XYZ system for the display panel, and each element in the matrix is a preset constant. Specifically, in a case where the gray scales of the six primary colors are Gray_R, Gray_G, Gray_B, Gray_YE, Gray_C and Gray_M, respectively, and the tristimulus values are Xmax, Ymax and Zmax, respectively, $X_R$, $X_G$, $X_B$, $X_{YE}$, $X_C$ and $X_M$ are conversion coefficients for converting the six primary colors into the stimulus value Xmax; $Y_R$, $Y_G$, $Y_B$, $Y_{YE}$, $Y_C$ and $Y_M$ are conversion coefficients for converting the six primary colors into the stimulus value Ymax; and $Z_R$, $Z_G$, $Z_B$, $Z_{YE}$, $Z_C$, and $Z_M$ are conversion coefficients for converting the six primary colors into the stimulus value Zmax.

It can be seen that since Xanax and Zmax can both be represented by an algebraic expression containing Ymax, and four of Gray_R, Gray_G, Gray_B, Gray_YE, Gray_C and Gray_M are known, three equations containing three unknowns can be obtained by the above formula (4), thereby obtaining a unique solution for the reference gray scale of each primary color.

After step S4, proceed to step S5: converting the reference gray scales of the plurality of primary colors of the target color into target gray scales, respectively, according to a proportional relationship between the reference luminance and the target luminance of the target color. Specifically, as shown in FIG. 2, the step S5 includes steps S51 and S52.

Step S51 includes: dividing the target luminance of the target color by the reference luminance of the target color to obtain a coefficient of proportionality k of the target luminance to the reference luminance. That is, k=Y0/Ymax.

Step S52 includes: for each primary color of the target color, obtaining a product of the reference gray scale of the primary color and the coefficient of proportionality, and using the obtained product as the target gray scale of the primary color.

Correspondingly, the present disclosure further provides a driving method for driving a display panel to display an image to be displayed. The display panel includes a plurality of display pixel units each including display sub-pixel units having a plurality of primary colors, and the number of the plurality of primary colors is greater than 3. The driving method includes:

obtaining color information of a target color of each image pixel unit in the image to be displayed; and converting the color information of the target color of each image pixel unit in the image to be displayed into gray scales of the plurality of primary colors by the multi-primary color conversion method provided by the present disclosure, the color information of the target color including color coordinates and a target luminance of the target color.

Then, a corresponding driving signal s provided to each display pixel unit of the display panel according to the gray scales of the plurality of primary colors such that each display pixel unit of the display panel displays the target color.

It should be noted that the driving method may directly generate a driving signal according to the gray scale of each primary color, or may perform rendering process on the gray scale of each primary color, and then generate a driving signal according to the gray scale subjected to the rendering process.

Correspondingly, the present disclosure also provides a computer readable storage medium having stored therein instructions, which when executed by a computer, cause the computer to perform the above multi-primary color conversion method.

Correspondingly, the present disclosure also provides a driving device for driving a display panel. The display panel includes a plurality of display pixel units, each of the plurality of display pixel units includes display sub-pixel units having a plurality of primary colors, and the number of the plurality of primary colors is greater than 3. The device includes at least one processor, and a memory for storing at least one program. The at least one program causes the at least one processor to perform the above driving method of the present disclosure when executed by the at least one processor.

Correspondingly, the present disclosure also provides a display device including a display panel and the driving device for driving the display panel. The display panel includes a plurality of display pixel units each including display sub-pixel units having a plurality of primary colors, and the number of the plurality of pixel units is greater than 3.

The plurality of display sub-pixel units include a red display sub-pixel unit, a green display sub-pixel unit, a blue display sub-pixel unit, a cyan display sub-pixel unit, a yellow display sub-pixel unit, and a magenta display sub-pixel unit.

Because the computer readable storage medium can cause a computer to perform the above driving method when running on the computer, the target gray scales of the six primary colors can be accurately obtained, and corresponding driving signals can be provided. Therefore, when the computer readable storage medium is running on the display device, the color actually displayed by the display device can be made closer to the target color, thereby improving the display effect.

The driving device for driving a display panel provided by the present disclosure includes at least one processor such as a CPU, and a memory such as a ROM for storing at least one program. The at least one program causes the at least one processor to perform the above driving method for driving the display panel when executed by the at least one processor.

The units or modules involved in the embodiments of the present disclosure may be implemented by software, or may be implemented by hardware. Each unit or module may be a software program in the processor. For example, each unit or module may be a software program in a computer or a mobile device; each unit or module may also be a separate hardware device. The names of the units or modules are not intended to limit the units or modules themselves.

It could be understood that the above implementations are merely exemplary implementations used for explaining the principle of the present disclosure, but the present disclosure is not limited thereto. Various modifications and improvements can be made by those skilled in the art without departing from the spirit and scope of the present disclosure, and such modifications and improvements are also considered to be within the scope of the present disclosure.

What is claimed is:

1. A multi-primary color conversion method for converting color information of a target color to be displayed into target gray scales of a plurality of primary colors, a number of the plurality of primary colors being greater than 3, the color information of the target color comprising color coordinates ($x_0$, $y_0$) and a target luminance ($Y_0$) of the target color, and the multi-primary color conversion method comprising:

establishing a spatial gamut model of a display panel in a CIE xyY color space according to all colors that the display panel is able to display, the spatial gamut model being formed by a plurality of peripheral surfaces and an xoy plane of the CIE xyY color space; wherein each of the plurality of peripheral surfaces has a plurality of vertices such that a projection of the peripheral surface on the xoy plane is in the shape of a polygon, each vertex of the polygon is a point at which a color obtained when at least one primary color has a maximum value is located, and inner regions of projections of the plurality of peripheral surfaces on the xoy plane do not overlap;

determining a target peripheral surface corresponding to the target color according to the color coordinates of the target color and color coordinates of a color corresponding to each vertex of each of the plurality of peripheral surfaces;

obtaining reference gray scales of a part of the plurality of primary colors of the target color according to gray scales of the plurality of primary colors of a color corresponding to each vertex of the target peripheral surface;

obtaining reference gray scales of the rest of the plurality of primary colors of the target color and a reference luminance of the target color according to the obtained reference gray scales of the part of the plurality of primary colors of the target color and a relationship between the gray scales of the plurality of primary colors of the target color and the reference luminance and the color coordinates of the target color; and converting the reference gray scale of each of the plurality of primary colors of the target color into a target gray scale according to a proportional relationship between the reference luminance and the target luminance of the target color.

2. The multi-primary color conversion method of claim 1, wherein the number of the plurality of primary colors is 6; and the step of obtaining reference gray scales of a part of the plurality of primary colors of the target color according to gray scales of the plurality of primary colors of a color corresponding to each vertex of the target peripheral surface comprises obtaining reference gray scales of four primary colors of the target color.

3. The multi-primary color conversion method of claim 2, wherein the step of obtaining reference gray scales of the rest of the plurality of primary colors of the target color and a reference luminance of the target color comprises:

determining the reference gray scales of the other two primary colors of the target color and the reference luminance Ymax of the target color according to the obtained reference gray scales of the four primary colors of the target color, the color coordinates ($x_0$, $y_0$) of the target color, and the following formula:

$$\begin{pmatrix} X_{max} \\ Y_{max} \\ Z_{max} \end{pmatrix} = \begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix} \begin{pmatrix} \text{Gray_R} \\ \text{Gray_G} \\ \text{Gray_B} \\ \text{Gray_YE} \\ \text{Gray_C} \\ \text{Gray_M} \end{pmatrix}$$

where four of Gray_R, Gray_G, Gray_B, Gray_YE, Gray_C, and Gray_M are the reference gray scales of the four primary colors obtained according to the gray scales of the plurality of primary colors of the color corresponding to each vertex of the target peripheral surface; and the other two are the reference gray scales of the other two primary colors to be determined;

Xmax, Ymax, and Zmax constitute tristimulus values corresponding to a color having color coordinates of ($x_0$, $y_0$) and a luminance of Ymax in the CIE XYZ system; and $$X_{max} = \frac{x_0}{y_0} Y_{max}, \text{ and } Z_{max} = \frac{1 - x_0 - y_0}{y_0} Y_{max}; \text{ and}$$

$$\begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix}$$

is a conversion matrix between gray scales of six primary colors and the tristimulus values in the CIE XYZ system for the display panel, each element in the matrix being a preset constant.

4. The multi-primary color conversion method of claim 3, wherein the step of establishing a spatial gamut model of a display panel in a CIE xyY color space according to all colors that the display panel is able to display comprises:

setting a plurality of sets of sample gray scales of the six primary colors, a sample gray scale of each primary color being within a preset gray scale range;

for each set of sample gray scales of the six primary colors, determining color coordinates (x', y') and luminance Y' of a sample color displayed by the display panel according to formula (1) and formula (2):

$$x' = \frac{X'}{X' + Y' + Z'} \quad (1)$$
$$y' = \frac{Y'}{X' + Y' + Z'}$$
$$z' = \frac{Z'}{X' + Y' + Z'}$$

$$\begin{pmatrix} X' \\ Y' \\ Z' \end{pmatrix} = \begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix} \begin{pmatrix} \text{Gray_R}' \\ \text{Gray_G}' \\ \text{Gray_B}' \\ \text{Gray_YE}' \\ \text{Gray_C}' \\ \text{Gray_M}' \end{pmatrix} \quad (2)$$

where Gray_R', Gray_G', Gray_B', Gray_YE', Gray_C' and Gray_M' are sample gray scales of the six primary colors, respectively; X', Y' and Z' constitute tristimulus values corresponding to the sample color in the CIE XYZ system; and $$\begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix}$$

is a conversion matrix between the sample gray scales of the six primary colors and the tristimulus values in the CIE XYZ system for the display panel, each element in the matrix being a preset constant; and establishing the spatial gamut model of the display panel in the CIE xyY color space according to the color coordinates and the luminances of all of the sample colors.

5. The multi-primary color conversion method of claim 4, wherein the step of obtaining reference gray scales of a part of the plurality of primary colors of the target color according to gray scales of the plurality of primary colors of a color corresponding to each vertex of the target peripheral surface comprises:

obtaining the gray scales of the six primary colors of the color corresponding to each vertex of the target peripheral surface, wherein a gray scale of each of L1 primary colors in the color corresponding to each vertex of the target peripheral surface is a maximum value in the preset gray scale range, and a gray scale of each of L2 primary colors in the color corresponding to each vertex of the target peripheral surface is a minimum value in the preset gray scale range, where L1 and L2 are both integers greater than or equal to 0, and L1+L2=4; and for each of the six primary colors, determining the reference gray scale of the primary color in the target color to be the maximum value in the preset gray scale range when the gray scale of the primary color in the color corresponding to each vertex is the maximum value in the preset gray scale range; and determining the reference gray scale of the primary color in the target color to be the minimum value in the preset gray scale range when the gray scale of the primary color in the color corresponding to each vertex is the minimum value in the preset gray scale range.

6. The multi-primary color conversion method of claim 4, wherein the preset gray scale range is 0 to 1; or the preset gray scale range is 0 to $2^n-1$, where n is an integer greater than 1.

7. The multi-primary color conversion method of claim 6, wherein the peripheral surface has four vertices such that the projection of the peripheral surface on the xoy plane of the CIE xyY color space is in the shape of a quadrangle; and the step of determining a target peripheral surface corresponding to the target color according to the color coordinates of the target color and color coordinates of a color corresponding to each vertex of each of the plurality of peripheral surfaces comprises:

obtaining the color coordinates ($x_0$, $y_0$) of the target color;

for each of the plurality of peripheral surfaces, obtaining color coordinates ($x_1$, $y_1$), ($x_2$, $y_2$), ($x_3$, $y_3$) and ($x_4$, $y_4$) of the colors corresponding to the vertices of the peripheral surface, and calculating values of a, b, c and d according to the following formula:

$$\begin{cases} a = (x_2 - x_1)(y_0 - y_1) - (y_2 - y_1)(x_0 - x_1) \\ b = (x_3 - x_2)(y_0 - y_2) - (y_3 - y_2)(x_0 - x_2) \\ c = (x_4 - x_3)(y_0 - y_3) - (y_4 - y_3)(x_0 - x_3) \\ d = (x_1 - x_4)(y_0 - y_4) - (y_1 - y_4)(x_0 - x_4) \end{cases},$$

and determining the peripheral surface to be the target peripheral surface corresponding to the target color when a, b, c and d are of a same sign.

8. The multi-primary color conversion method of claim 7, wherein the step of converting the reference gray scale of each of the plurality of primary colors of the target color into a target gray scale according to a proportional relationship between the reference luminance and the target luminance of the target color comprises:

dividing the target luminance of the target color by the reference luminance of the target color to obtain a coefficient of proportionality of the target luminance to the reference luminance; and for each of the plurality of primary colors of the target color, obtaining a product of the reference gray scale of the primary color and the coefficient of proportionality, and using the obtained product as the target gray scale of the primary color.

9. The multi-primary color conversion method of claim 8, wherein the plurality of primary colors comprise red, green, blue, yellow, cyan, and magenta.

10. A driving method for driving a display panel to display an image to be displayed, wherein the display panel comprises a plurality of display pixel units each comprising display sub-pixel units having a plurality of primary colors, a number of the plurality of primary colors being greater than 3, and the driving method comprises:

obtaining color information of a target color of each image pixel unit in the image to be displayed;

converting the color information of the target color of each image pixel unit in the image to be displayed into gray scales of the plurality of primary colors by the multi-primary color conversion method of claim 9, the color information of the target color comprising color coordinates and a target luminance of the target color; and providing a corresponding driving signal to each display pixel unit of the display panel according to the gray scales of the plurality of primary colors to cause each display pixel unit of the display panel to display the target color.

11. The multi-primary color conversion method of claim 2, wherein the step of establishing a spatial gamut model of a display panel in a CIE xyY color space according to all colors that the display panel is able to display comprises:

setting a plurality of sets of sample gray scales of the six primary colors, a sample gray scale of each primary color being within a preset gray scale range;

for each set of sample gray scales of the six primary colors, determining color coordinates (x', y') and luminance Y' of a sample color displayed by the display panel according to formula (1) and formula (2):

$$x' = \frac{X'}{X' + Y' + Z'} \quad (1)$$

$$y' = \frac{Y'}{X' + Y' + Z'}$$

$$z' = \frac{Z'}{X' + Y' + Z'}$$

$$\begin{pmatrix} X' \\ Y' \\ Z' \end{pmatrix} = \begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix} \begin{pmatrix} \text{Gray_R}' \\ \text{Gray_G}' \\ \text{Gray_B}' \\ \text{Gray_YE}' \\ \text{Gray_C}' \\ \text{Gray_M}' \end{pmatrix} \quad (2)$$

where Gray_R', Gray_G', Gray_B', Gray_YE', Gray_C' and Gray_M' are sample gray scales of the six primary colors, respectively; X', Y' and Z' constitute tristimulus values corresponding to the sample color in the CIE XYZ system; and $$\begin{pmatrix} X_R & X_G & X_B & X_{YE} & X_C & X_M \\ Y_R & Y_G & Y_B & Y_{YE} & Y_C & Y_M \\ Z_R & Z_G & Z_B & Z_{YE} & Z_C & Z_M \end{pmatrix}$$

is a conversion matrix between the sample gray scales of the six primary colors and the tristimulus values in the CIE XYZ system for the display panel, each element in the matrix being a preset constant; and establishing the spatial gamut model of the display panel in the CIE xyY color space according to the color coordinates and the luminances of all of the sample colors.

12. The multi-primary color conversion method of claim 11, wherein the step of obtaining reference gray scales of a part of the plurality of primary colors of the target color according to gray scales of the plurality of primary colors of a color corresponding to each vertex of the target peripheral surface comprises:

obtaining the gray scales of the six primary colors of the color corresponding to each vertex of the target peripheral surface, wherein a gray scale of each of L1 primary colors in the color corresponding to each vertex of the target peripheral surface is a maximum value in the preset gray scale range, and a gray scale of each of L2 primary colors in the color corresponding to each vertex of the target peripheral surface is a minimum value in the preset gray scale range, where L1 and L2 are both integers greater than or equal to 0, and L1+L2=4; and for each of the six primary colors, determining the reference gray scale of the primary color in the target color to be the maximum value in the preset gray scale range when the gray scale of the primary color in the color corresponding to each vertex is the maximum value in the preset gray scale range; and determining the reference gray scale of the primary color in the target color to be the minimum value in the preset gray scale range when the gray scale of the primary color in the color corresponding to each vertex is the minimum value in the preset gray scale range.

13. The multi-primary color conversion method of claim 11, wherein the preset gray scale range is 0 to 1; or the preset gray scale range is 0 to $2^n-1$, where n is an integer greater than 1.

14. The multi-primary color conversion method of claim 1, wherein the peripheral surface has four vertices such that the projection of the peripheral surface on the xoy plane of the CIE xyY color space is in the shape of a quadrangle; and the step of determining a target peripheral surface corresponding to the target color according to the color coordinates of the target color and color coordinates of a color corresponding to each vertex of each of the plurality of peripheral surfaces comprises:

obtaining the color coordinates ($x_0$, $y_0$) of the target color;

for each of the plurality of peripheral surfaces, obtaining color coordinates ($x_1$, $y_1$), ($x_2$, $y_2$), ($x_3$, $y_3$) and ($x_4$, $y_4$) of the colors corresponding to the vertices of the peripheral surface, and calculating values of a, b, c and d according to the following formula:

$$\begin{cases} a = (x_2 - x_1)(y_0 - y_1) - (y_2 - y_1)(x_0 - x_1) \\ b = (x_3 - x_2)(y_0 - y_2) - (y_3 - y_2)(x_0 - x_2) \\ c = (x_4 - x_3)(y_0 - y_3) - (y_4 - y_3)(x_0 - x_3) \\ d = (x_1 - x_4)(y_0 - y_4) - (y_1 - y_4)(x_0 - x_4) \end{cases},$$

and determining the peripheral surface to be the target peripheral surface corresponding to the target color when a, b, c and d are of a same sign.

15. The multi-primary color conversion method of claim 1, wherein the step of converting the reference gray scale of each of the plurality of primary colors of the target color into a target gray scale according to a proportional relationship between the reference luminance and the target luminance of the target color comprises:

dividing the target luminance of the target color by the reference luminance of the target color to obtain a coefficient of proportionality of the target luminance to the reference luminance; and for each of the plurality of primary colors of the target color, obtaining a product of the reference gray scale of the primary color and the coefficient of proportionality, and using the obtained product as the target gray scale of the primary color.

16. The multi-primary color conversion method of claim 1, wherein the plurality of primary colors comprise red, green, blue, yellow, cyan, and magenta.

17. A driving method for driving a display panel to display an image to be displayed, wherein the display panel comprises a plurality of display pixel units each comprising display sub-pixel units having a plurality of primary colors, a number of the plurality of primary colors being greater than 3, and the driving method comprises:

obtaining color information of a target color of each image pixel unit in the image to be displayed;

converting the color information of the target color of each image pixel unit in the image to be displayed into gray scales of the plurality of primary colors by the multi-primary color conversion method of claim 1, the color information of the target color comprising color coordinates and a target luminance of the target color; and providing a corresponding driving signal to each display pixel unit of the display panel according to the gray scales of the plurality of primary colors to cause each display pixel unit of the display panel to display the target color.

18. A driving device for driving a display panel, the display panel comprising a plurality of display pixel units, each of the plurality of display pixel units comprising display sub-pixel units having a plurality of primary colors, and a number of the plurality of primary colors being greater than 3, wherein the device comprises at least one processor, and a memory for storing at least one program; the at least one program causes the at least one processor to perform the driving method of claim 17 when executed by the at least one processor.

19. A display device, comprising a display panel and the driving device for driving the display panel of claim 18, wherein the display panel comprises a plurality of display pixel units each comprising display sub-pixel units having a plurality of primary colors, a number of the plurality of pixel units being greater than 3.

20. The display device of claim 19, wherein the display sub-pixel units having a plurality of primary colors comprise a red display sub-pixel unit, a green display sub-pixel unit, a blue display sub-pixel unit, a cyan display sub-pixel unit, a yellow display sub-pixel unit, and a magenta display sub-pixel unit.

* * * * *